United States Patent [19]

Desmarais et al.

[11] 4,145,830

[45] Mar. 27, 1979

[54] ALBUM LEAF

[76] Inventors: Claude Desmarais, 17 Linwood Crescent; Gerard Desmarais, 425 Lockhart, both of Mount Royal, Quebec, Canada

[21] Appl. No.: 727,983

[22] Filed: Sep. 29, 1976

[30] Foreign Application Priority Data

Oct. 2, 1975 [CA] Canada ..... 236918

[51] Int. Cl.[2] ..... B42F 3/00

[52] U.S. Cl. ..... 40/404; 40/158 B

[58] Field of Search ..... 40/158, 159, 152, 154, 40/104.19, 104.18; 281/20, 404, 405

[56] References Cited

U.S. PATENT DOCUMENTS

| | | | |
|---|---|---|---|
| 2,115,130 | 4/1938 | Thurn et al. | 40/152 X |
| 2,299,266 | 10/1942 | Engel | 40/158 B |

FOREIGN PATENT DOCUMENTS

| | | | |
|---|---|---|---|
| 521159 | 1/1956 | Canada | 281/20 |
| 256801 | 2/1913 | Fed. Rep. of Germany | 281/20 |
| 273702 | 8/1928 | United Kingdom | 281/20 |

*Primary Examiner*—Russell R. Kinsey
*Assistant Examiner*—Wenceslao J. Contreras
*Attorney, Agent, or Firm*—Stevens, Davis, Miller & Mosher

[57] ABSTRACT

An album leaf and method of making it is disclosed. The leaf has a peripheral frame of metal or other suitable material which includes a bead and inwardly extending skirts for holding a base sheet therebetween. Adhesive means on the surface of the skirt retain a mat thereon, securing a photograph beneath the mat. A hinge segment is attached to the binding edge of the leaf.

3 Claims, 8 Drawing Figures

FIG. 5
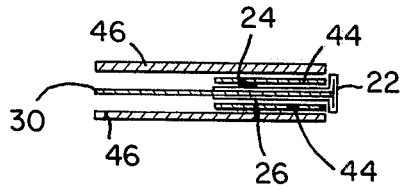
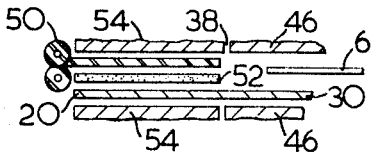
FIG. 6
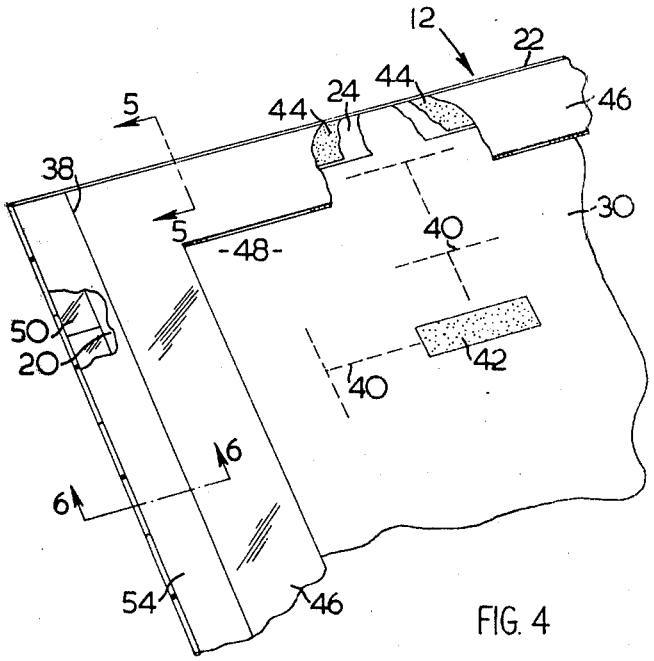
FIG. 4

ALBUM LEAF

This invention relates to albums for photographs and in particular to the structure of leaves for such albums and the method of making them.

Known album leaves include one type that has open ended photo mats over base sheets and covered with acetate envelopes. Such sheets have several inherent disadvantages. The open or exposed side edges of the sheets tend to tear during repeated use. The acetate envelope covers the photograph and causes light reflections on the surface thereof. This inhibits the textured surface of the photograph to be seen.

Another known form of leaf construction includes a plastic border bead with a single dependent skirt with a photo mat adhesively secured thereto. However, in such an arrangement there is no flexibility in changing the mat from horizontal to vertical formats or vice versa. The person making up the album must therefore stock numerous mat formats which are, in effect, integrally formed with their associated bead and single skirt.

The album leaf according to the present invention overcomes the above deficiencies of the known forms of leaf construction and provides a frame structure ready to receive any mat format thereon to provide the person assembling the album with increased flexibility in making the finished product. Moreover, a leaf made in accordance with the invention allows full exposure of the surface of the photograph with the mat being the only additional surface exposed to the viewer. A complete album utilizing leaves made according to the invention provides a book of symmetrical and neat appearance.

According to one broad aspect, therefore, the present invention relates to a photo album leaf for supporting a photograph or the like on at least one side thereof, said album leaf comprising a frame defining a closed top edge, bottom edge and at least one closed side edge of said leaf, said frame including an outer peripheral bead and a pair of skirts extending inwardly thereof to form a three sided, sheet receiving channel; a planar base sheet having three of its terminal side edges secured between the inwardly extending skirts of said frame; and means on at least one upper side of said skirts for securing a photograph mat thereto.

According to another broad aspect, the present invention relates to the method of making a photo album leaf comprising the steps of:

(a) providing a metal frame member having a bead edge with two skirts extending therefrom to define a sheet receiving channel;
(b) applying a double faced adhesive to the outer surface of at least one skirt;
(c) notching said skirts and forming said frame member into a rectangular 'C' shape defining closed top, bottom and a closed side edge and one open edge;
(d) inserting a photo supporting base sheet into said channels of the skirts; and
(e) applying pressure to said skirts to crimp the surfaces thereof onto the base sheet to frictionally hold the same between said skirts.

These and other features of the invention will be appreciated from the following disclosure and accompanying drawings wherein:

FIG. 4 is a fragmentary perspective view of an assembled leaf;

FIG. 5 is a cross-sectional view taken along the line 5—5 of FIG. 4;

FIG. 6 is a cross-sectional view taken along the line 6—6 of FIG. 4;

Figure 1:
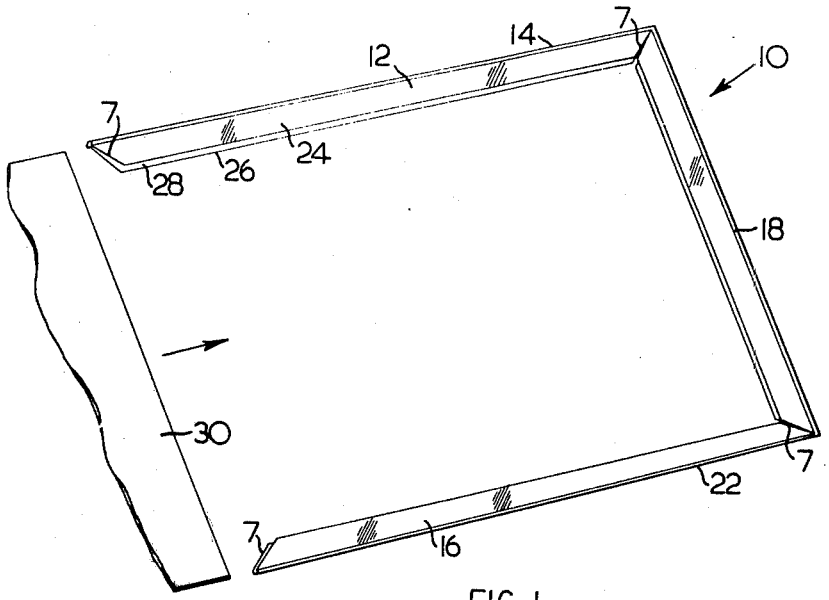
FIG. 1 is a perspective view of the album leaf frame.
Figure 3:
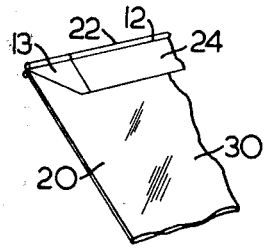
FIG. 3 is a fragmentary perspective view of the binding edge of the leaf.
Figure 2:
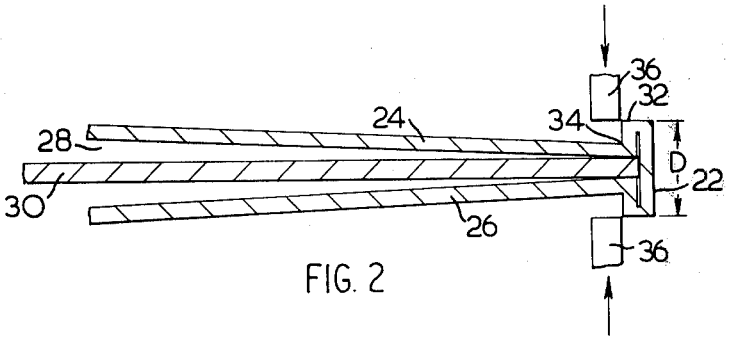
FIG. 2 is a cross sectional view of the frame with the base sheet therein.

Referring to FIGS. 1–3, an album leaf indicated generally at 10 has a frame 12 enclosing the top and bottom edges 14, 16 and one "outer" side edge 18. The inner or binding edge 20 being free. As seen clearly in FIG. 2, the frame 12 is formed to provide an outer border or peripheral bead 22 with a pair of integral skirts 24, 26 extending inwardly of the leaf and defining between them a sheet receiving channel 28. As shown, a base 30, (which with the frame skirts 24, 26, eventually support the photograph) is inserted into the channels 28 until the position of FIG. 2 is reached with the terminal side edges of the base sheet 30 reaching substantially to the "bottom" of the channel 28.

Figure 8:
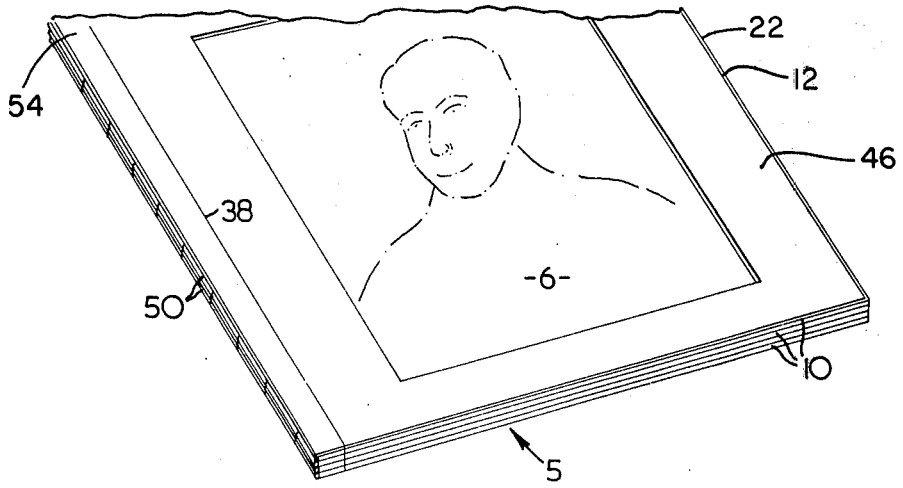
FIG. 8 is a perspective view of an album with the covers removed.

In its preferred form, the frame bead 22 has an overall thickness or depth 'D' substantially equal to the combined thickness of the finished leaf 10 so that a neat, uncluttered appearance is provided as shown in FIG. 8. The bead 22 is thereformed formed into a twin legged 'T' shape with shoulders 32 intersecting at 34 with the upper ends of skirts 24 and 26. With the base sheet 30 inserted in the channel 28 as shown in FIG. 2, suitable pressure tools 36 are then applied at the locations shown, specifically at and immediately adjacent to intersection 34, to bend the upper ends of the skirts 24, 26 relative to the shoulders 32 and thereby press the inner surfaces of the skirts onto the adjacent faces of the sheet 30 so that a tight frictional hold on the sheet is provided. (See FIG. 5)

FIG. 3 shows a segment of a leaf in which the base sheet 30 has been inserted in the frame 12 and where the skirts 24, 26 have been pressed to hold the sheet as mentioned above. In addition it will be noted that the binding edge 20 is provided on upper and lower edges (the latter not being shown) with a segment 13 of frame 12 which is in alignment with but separate from the main frame 12. The portion of the binding edge 20 defined by the segments 13 (and the line 38 in FIG. 4) is referred to herein as the hinge supporting side edge.

Turning to FIG. 4, it will be noted that the base sheet 30 preferably includes a printed centering grid 40 for numerous sizes of photographic prints and an adhesive strip 42 to provide means for holding the photograph on the desired grid markings until the covering mat is applied.

While omitted from FIG. 1 for the sake of clarity, FIGS. 4 and 5 show that the outer surfaces of the frame skirts 24, 26 are provided with double faced adhesive tape 44. After a photo print has been applied to the base 30 and temporarily secured to the adhesive 42, a mat 46 having an opening 48 of desired configuration, such as rectangular, heart shaped, vertical or horizontal, is applied to the leaf 10 so that that strips of the mat 46 adjacent its top, bottom and outer edges are adhesively secured to the upper, exposed face of the adhesive 44, as shown.

Referring to the left side of FIG. 4 and to FIG. 6, an elongated hinge segment 50 is secured by double face adhesive 52 to the hinge supporting side edge 20 of the base sheet 30 and mat strips 54 are similarly secured to the hinge segment 50 on the top of the leaf 10 and to the binding edge 20 on the bottom of the leaf as illustrated in FIG. 6.

Figure 7:
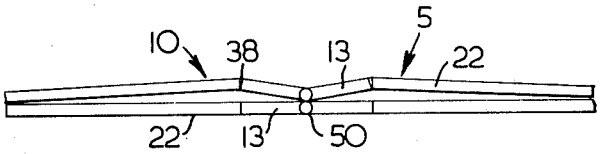
FIG. 7 is an end view of an opened album incorporating leaves of the present invention.

The advantage of using separate frame strips 13 for the hinge supporting or binding edge 20 of the sheet from that of the main frame 12, will be appreciated from FIG. 7. An album 5 is opened out for viewing and while the frictional engagement of the hinge segments 50 maintains the binding edges 20 in an upwardly angular position which normally could cause a bend in the leaf 10 and its photograph, the provision of segment 13 allows the main frame, mat and photo to lie substantially flat as illustrated.

FIG. 8 shows a complete album 5, which its cover omitted, made up from leafs 10 of the present invention. It will be noted that the side edges of the album display only the bead portion 22 of the frame 12 of each leaf 10. While the photograph 6 is frictionally held between the surfaces the mat 46 and the base sheet 30, it will be appreciated that the edge of the mat 46 adjacent the line 38 is not adhesively secured and therefore can be opened if necessary to remove the photograph 6 which need only to be pulled off the centering adhesive 42.

While various materials may be used for the frame 12, aluminum anodized in selected colors is preferred with the depth of the skirts being approximately ⅜ inch and the width of the bead being approximately 0.081 inch.

A leaf 10 is made in accordance with the following method:

(a) the frame metal is roll formed into the desired shape shown in FIG. 2;

(b) double faced tape 44 is applied to the outer surfaces of the frame skirts 24 and 26;

(c) the frame 12, in strip form, is notched at 7 in the desired locations and bent into open ended form as shown in FIG. 1; and segments 13 are broken (FIG. 3);

(d) the base paper 30 is inserted into the frame 12 as shown in FIGS. 1 and 2;

(e) the skirts 24, 26 are crimped and pressed as shown in FIG. 2 to provide a good frictional hold on the base 30;

(f) the frame 12 with base 30 is jig held and the hinge segment 50 is applied. The neat strip 54 may be applied at this stage also.

The leaf 10 is now in its "stock" form for delivery, ready to receive the photograph 6 in the manner previously described and the finishing mat 46. The desired number of leaves 10 there can be formed into an album 5.

While the invention has been described in connection with a specific embodiment thereof and in a specific use, various modifications thereof illl occur to those skilled in the art without departing from the spirit and scope of the invention as set forth in the appended claims.

The terms and expressions which have been employed in this specification are used as terms of description and not of limitation, and there is no intention in the use of such terms and expressions to exclude any equivalents of the features shown and described or portions thereof, but it is not recognized that various modifications are possible within the scope of the invention claimed.

The embodiments of the invention in which an exclusive property or privilege is claimed are defined as follows:

1. A photo album leaf for supporting a photograph or the like on at least one side thereof, said album leaf comprising:

a frame defining closed top and bottom edges and one closed side edge;

said frame including an outer peripheral bead and a pair of skirts extending inwardly therefrom to form a three sided sheet-receiving channel;

a planar base sheet positioned in said frame and having three of its terminal side edges secured between the inwardly extending skirts of said frame, the remaining free edge providing an open, hinge supporting marginal surface opposite said closed side edge and adapted to support an album hinge segment;

the portions of the frame bead and skirts on the top and bottom edges of the frame, securing the hinge supporting marginal surface of the base sheet, being in alignment with but detached from the bead and skirts on the remainder of the top and bottom edges.

2. An album leaf according to claim 1 including an album hinge segment secured to the hinge supporting marginal surface.

3. An album leaf according to claim 1 including adhesive means on said skirts for securing a photograph mat on the leaf.

* * * * *